US005327199A

United States Patent [19]

Sekine

[11] Patent Number: 5,327,199

[45] Date of Patent: Jul. 5, 1994

[54] DEVELOPING DEVICE FOR A COLOR IMAGE FORMING APPARATUS

[75] Inventor: Takeyoshi Sekine, Tokyo, Japan

[73] Assignee: Ricoh Company, Ltd., Tokyo, Japan

[21] Appl. No.: 108,195

[22] Filed: Aug. 18, 1993

[30] Foreign Application Priority Data

Aug. 20, 1992 [JP] Japan ..... 4-244317

[51] Int. Cl.[5] ..... G03G 15/06

[52] U.S. Cl. ..... 355/245; 355/251; 355/253; 355/326 R; 118/656; 118/657

[58] Field of Search ..... 355/326 R, 327, 328, 355/245, 251, 253; 118/656-658

[56] References Cited

U.S. PATENT DOCUMENTS 5,036,364 7/1991 Murasawa ..... 355/251

FOREIGN PATENT DOCUMENTS 0011857 1/1985 Japan .
0243473 10/1986 Japan .
0172985 7/1989 Japan .
0298382 12/1989 Japan .
0166484 6/1990 Japan .

*Primary Examiner*—Matthew S. Smith
*Attorney, Agent, or Firm*—Oblon, Spivak, McClelland, Maier & Neustadt

[57] ABSTRACT

A developing device for an electrophotographic color image forming apparatus and having a plurality of developing units each storing a two-component developer of particular color. In each developing unit, to bring the developer deposited on a developing sleeve to an inoperative position, the sleeve is rotated in a direction opposite to a direction for development. At this instant, the developer flowing in the opposite direction is introduced partly into a gap between the developing sleeve and a doctor and partly into a bypass formed between the doctor and the casing of the developing unit.

10 Claims, 13 Drawing Sheets

DEVELOPING DEVICE FOR A COLOR IMAGE FORMING APPARATUS

BACKGROUND OF THE INVENTION

The present invention relates to a copier, facsimile, printer or similar electrophotographic image forming apparatus and, more particularly, to a developing device having a plurality of developing units arranged around a photoconductive element of a color image forming apparatus and each storing a two-component developer of particular color.

In a color image forming apparatus of the type described, developing units other than one in operation have to be brought out of contact with a photoconductive element, or image carrier, so as not to disturb a latent image and corresponding toner image formed on the drum. For this purpose, it has been customary to move the developing units other than operating one away from a developing position or to bring the magnet brush formed by a developer on each developing sleeve to an inoperative position. The problem with the former scheme is that an extra space for switching the developing units is needed to render the entire apparatus bulky. In addition, such a scheme is not practicable without complicating the switching mechanism and driving mechanism. The latter scheme does not require an extra space and is simple and useful in respect of mechanical arrangement. However, should the developer be not completely brought to the inoperative position, it would contact or adjoin the drum to disturb a latent image and corresponding toner image or deposit on the drum.

SUMMARY OF THE INVENTION

It is, therefore, an object of the present invention to provide a developing device for a color image forming apparatus which insures an attractive image over a long period of time by preventing a developer remaining on a developing sleeve of a developing unit out of operation from disturbing a latent image and toner image.

It is another object of the present invention to provide a developing device for a color image forming apparatus which prevents a developer remaining on a developing sleeve of a developing unit from being scattered around to contaminate the interior of the apparatus when it is brought to an inoperative position.

In accordance with the present invention, a developing device capable of bringing a developer deposited on a developing sleeve to an inoperative position by rotating the developing sleeve in a direction opposite to a direction for development has a doctor for regulating the thickness of a layer formed by the developer on the developing sleeve. The developer flows through a gap between the doctor and the developing sleeve when transported toward the inoperative position in a reverse direction. A a bypass causes part of the developer being transported in the reverse direction to flow therethrough.

BRIEF DESCRIPTION OF THE DRAWINGS

The above and other objects, features and advantages of the present invention will become more apparent from the following detailed description taken with the accompanying drawings in which.

In the figures, the same or similar constituent parts are designated by the same reference numerals.

DESCRIPTION OF THE PREFERRED EMBODIMENTS

Figure 12:
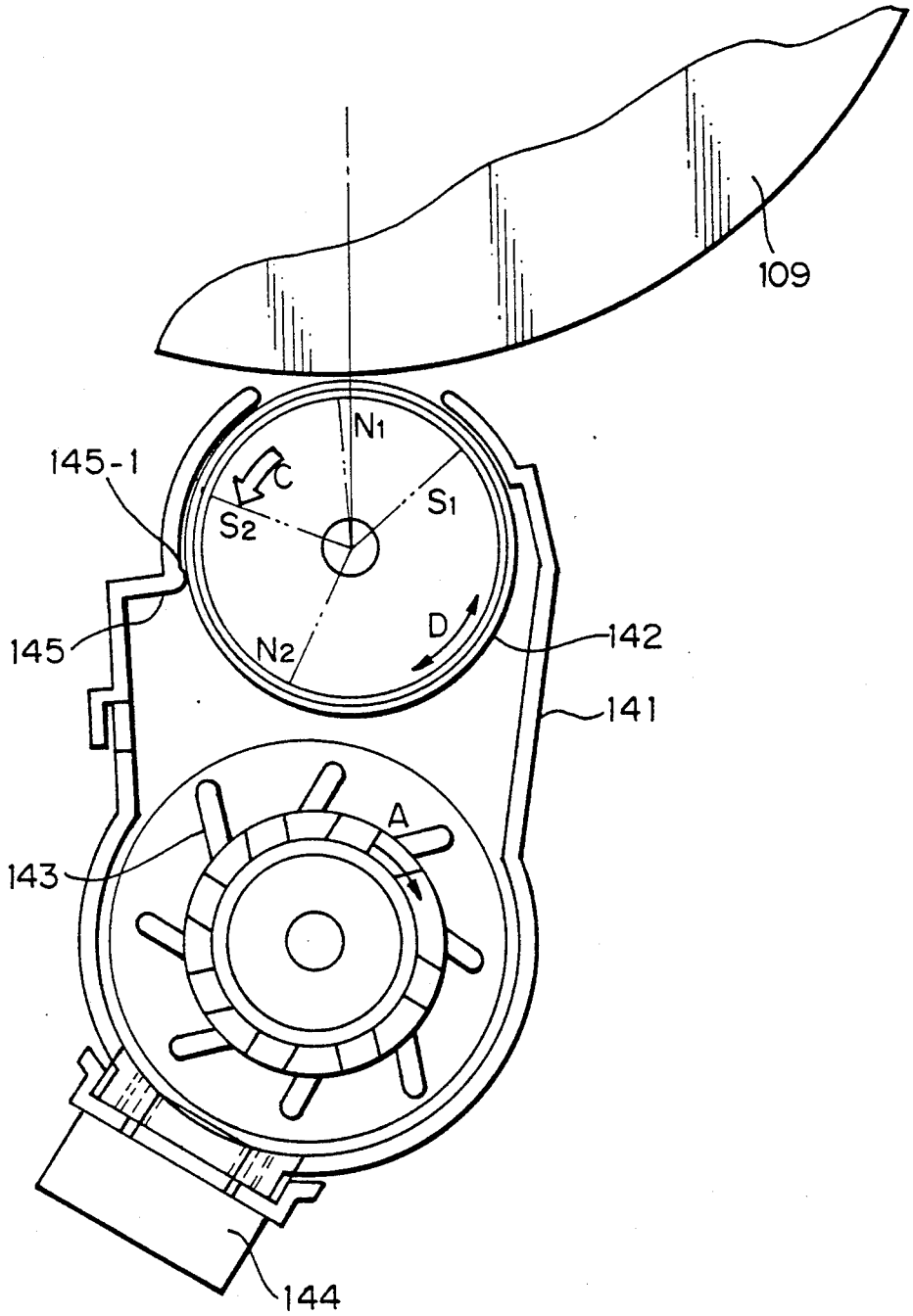
Fig. 12 PRIOR ART
FIG. 12 is a sectional side elevation showing essential part of a conventional developing device.

To better understand the present invention, a brief reference will be made to a conventional developing device, shown in FIG. 12. As shown, the developing device has a developing unit or casing 141 located to face a photoconductive element implemented as a drum 109. A paddle 143 is disposed in the casing 141 for agitating a developer stored therein. A toner sensor 144 is responsive to the toner concentration of the developer. A developing sleeve 142 has a magnetic field generating member thereinside. A doctor 145 regulates the thickness of a layer formed by the developer, i.e., the amount of developer to be scooped up. During development, the developing sleeve 142 is rotated in a direction opposite to the direction indicated by an arrow C in the figure. The paddle 143 is rotated in a direction indicated by an arrow A to agitate and convey the developer. Then, the developer is deposited on the developing sleeve 142 by the transport magnetic pole N2 of the sleeve 142. As the developer is transported by the developing sleeve 142, it is regulated in amount by the doctor 145. Part of the developer shaved off by the doctor 145 is let fall. On reaching a developing region, the developer develops a latent image electrostatically formed on the drum 109 due to the main magnetic pole for development N1 of the sleeve 142. After the development, the developer is further transported to the downstream side by the transport magnetic pole S1 of the sleeve 142. As this part of the developer reaches a region (arrow D) where no magnetic forces act, it comes off the sleeve 142. In this connection, the magnetic poles N1, N2, S1 and S2 are each representative of the center value (peak value) of the magnetic force distribution.

On completing the development, the developing sleeve 142 is stopped and then reversed in the direction C. At this instant, part of the developer having not reached the region D is transported in the opposite direction to the developing direction, i.e., via S1, N1 and S2 to arrive at the doctor 145 again. While the developer flows through the narrow gap of the doctor 145, i.e., a doctor gap, it is subjected to an excessive and needless stress at a position 145-1 adjacent to the doctor gap since the way out existed in the event of development is not available. It is to be noted that the doctor 145 also serves to promote the frictional charging of carrier and toner by stressing the developer in the magnetic field. However, promoting the frictional charging of the developer is not necessary in the event when the developer is brought to an inoperative position after development.

Figure 13:
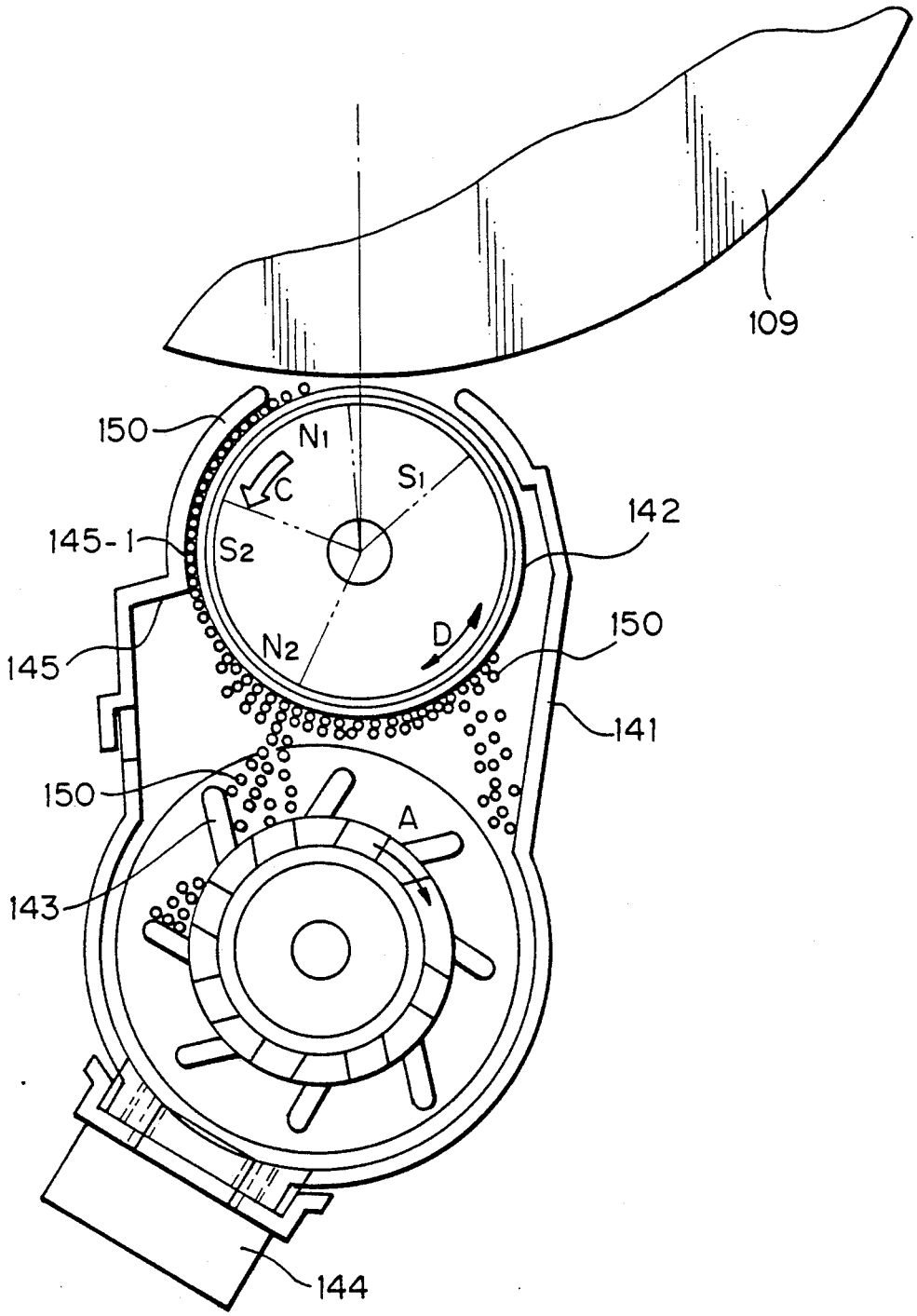
Fig. 13 PRIOR ART
FIG. 13 is a view demonstrating how a developer flows toward an inoperative position in the conventional device shown in FIG. 12.

FIG. 13 shows another conventional developing device. As shown, as the developing sleeve 142 is reversed (direction C), a developer 150 deposited thereon is sequentially transported by the magnetic poles N1, S1 and N2 and then let fall in the region D where no magnetic forces act. At this instant, the paddle 143 is in rotation. This brings about a problem that the paddle 143 conveys additional developer 150 toward the developing sleeve 142. The additional developer 150 is deposited on the sleeve 142 by the pole N2, degrading the ability to bring the developer to an inoperative position.

To enhance image quality, there have recently been proposed a developing system which superposes AC on a bias for development, a developing system which reduces the gap for development, etc. However, these systems are disadvantageous in that an oscillatory electric field ascribable to the AC bias causes the developer remaining on the developing sleeve to stand in rows along the magnetic lines of force of the developing pole. This part of the developer effects the latent image and corresponding toner image without regard to the amount thereof. This problem becomes more serious as the gap for development decreases.

To bring a developer to an inoperative position, some different methods have been proposed, e.g., one which reverses the rotation of the developing sleeve, one which rotates the sleeve in the same direction as during development while changing the angle of magnets or inserting a magnetic short-circuiting plate, one which mechanically scrapes off the developer, and a combination of such methods. Among them, the method reversing the sleeve is most simple and most desirable from the performance and reliability standpoint. However, since this kind of method causes the developer to rush into the narrow doctor gap from the developer region, the developer is strongly urged against the developing sleeve. As a result, the service life of the developer is reduced due to fatigue. Moreover, the toner existing in the casing of the developing unit has the charge thereof lowered due to such fatigue. This not only causes the toner to be scattered around to contaminate the interior of the apparatus, but also increases the amount of toner to deposit on the background of the drum without contributing to image formation. Consequently, the supply cost per copy is increased. In addition, since the amount of developer to pass the developing region sharply changes when the developer is brought to an inoperative and an operative position, the torque acting on the drum drive shaft sharply changes. It is likely, therefore, that the rotation speed of the drum drive shaft temporarily runs out of control, i.e., another image being formed or transferred is enlarged, reduced or otherwise disturbed. A motor having great torque may be used to drive the drum for eliminating the above problem, but such a motor is bulky and increases the cost.

Figure 1:
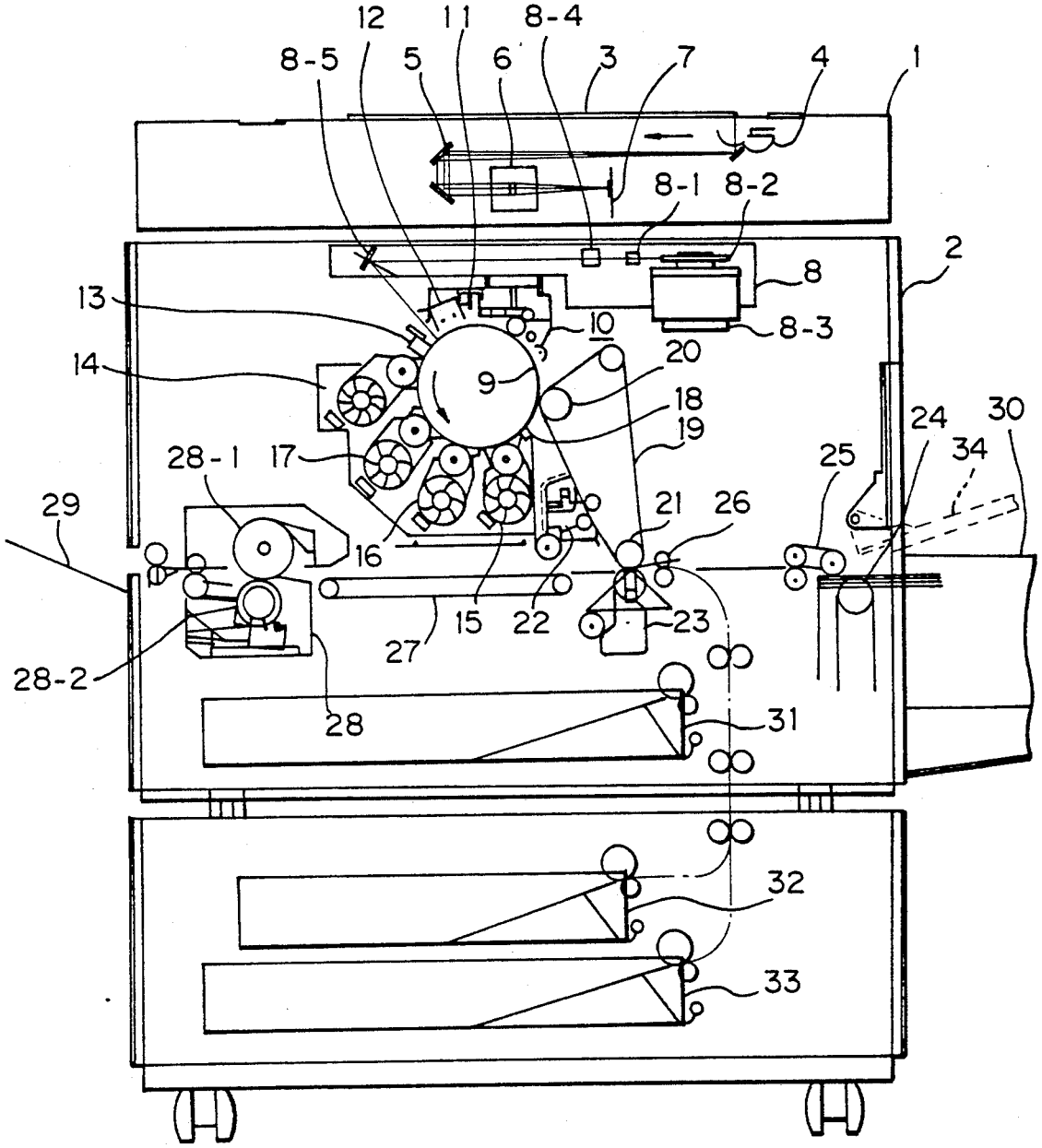
FIG. 1 is a section showing a color copier to which preferred embodiments of the developing device in accordance with the present invention are applicable.

Referring to FIG. 1, an image forming apparatus to which embodiments of the present invention to be described are applied is shown and implemented as a color copier by way of example. As shown, the color copier has a color image reading unit or color scanner 1, and a color image recording unit or color printer 2. In the color scanner 1, a lamp 4 illuminates a document 3 laid on a glass platen (no numeral). The resulting reflection from the document 3 is routed through mirrors 5 to a lens 6 and focused onto a CCD array or similar photoelectric transducer 7 by the lens 6. As a result, the transducer 7 reads the color image information of the document 3 while separating them into, e.g., blue, green and red components, thereby generating corresponding image signals. Specifically, the transducer 7 is made up of blue, green and red color separating means and a CCD array or similar photoelectric transducer and reads the three color components at the same time. An image processing section, not shown, performs color conversion on the basis of the signal levels of the blue, green and red image signals generated by the color scanner 1, thereby producing black (BK), cyan (C), magenta (M) and yellow (Y) color image data.

Subsequently, the color printer 2 produces a color copy by combining BK, C, M and Y toner images, as will be described specifically later. To produce the BK, C, M and Y image data, as the color scanner 1 receives a scanner start signal synchronous to the operation of the color printer 2, it causes the light source and mirrors thereof to scan the document 3 while moving to the left, as viewed in the figure. This scanning movement is repeated four consecutive times to sequentially produce four colors of image data. Every time one color of image data is generated, the color printer 2 produces a corresponding toner image. The resulting four toner images are combined to complete a full color image.

The color printer 2 will be outlined hereinafter. An optical writing unit 8 transforms the color image data sent from the color scanner 1 to an optical signal and electrostatically forms a latent image corresponding to the document image on a photoconductive drum 9 with the optical signal. The writing unit 8 has a semiconductor laser 8-1, a laser driver, not shown, a polygon mirror 8-2, a motor 8-3 for driving the mirror 8-2, an f-theta lens 8-4, a mirror 8-5, etc. The drum 9 is rotatable counterclockwise, as indicated by an arrow in the figure. Arranged around the drum 9 are a drum cleaning unit, including a precleaning discharger, 10, a discharge lamp 11, a main charger 12, a potential sensor 13, a BK developing unit 14, a C developing unit 15, an M developing unit 16, a Y developing unit 17, a pattern sensor 18 responsive to a particular density pattern, an intermediate image transfer belt 19, etc.

As shown in FIG. 1 in a fragmentary enlarged view, the BK developing unit 14 has a developing sleeve, or developer carrier, 14-1 rotatable in contact with the drum 9, a paddle 14-2 for scooping and agitating a developer, and a toner sensor 14-3 responsive to the concentration of a BK toner contained in the developer. Likewise, the C, M and Y developing units respectively have developing sleeves 15-1, 16-1 and 17-1, paddles 15-2, 16-2 and 17-2, and toner sensors 15-3, 16-3 and 17-3.

While all of the four developing units 14–17 are out of operation, they maintain the associated developers in an inoperative position. The operation of the developing device will be described hereinafter on the assumption that BK, C, M and Y images are sequentially formed in this order, although such an order is only illustrative.

On the start of a copying operation, the color scanner 1 starts reading the document 3 to generate BK image data. In response to the BK image data, the color printer 2 starts forming a BK latent image on the drum 9 with a laser beam. To develop the BK latent image from the leading edge thereof, the BK developing sleeve 14-1 begins to rotate to bring the associated developer to an operative position before the leading edge of the latent image arrives at the developing position of the BK developing unit 14. As a result, the BK latent image is developed by a BK toner. As soon as the trailing edge of the BK latent image moves away from the BK developing position, the developer on the sleeve 14-1 is brought to an inoperative position. This is completed at least before the leading edge of a C latent image to follow arrives at the BK developing position. To bring the developer to the inoperative position, the rotation of the BK sleeve 14-1 is reversed.

The BK toner image formed on the drum 9 by the above procedure is transferred to the intermediate transfer belt 19 being rotated at the same speed as the drum 9. Let the image transfer from the drum 9 to the belt 19 be referred to as a belt transfer for simplicity. For the belt transfer, while the drum 9 and belt 19 are held in contact, a predetermined bias voltage is applied to a bias roller 20. BK, C, M and Y toner images sequentially formed on the drum 9 are sequentially transferred to the belt 19 one above the other to form a four-color composite image. This composite image is collectively transferred from the belt 19 to a recording medium, e.g., a paper sheet. The belt 19 is built in a unit, i.e., an intermediate transfer belt unit which will be described later.

As the color scanner 1 starts generating C image data after the BK image data at a predetermining timing, the color printer 2 forms a C latent image with a laser beam representative of the C image data. Specifically, the C developing unit 15 starts rotating the sleeve 15-1 after the trailing edge of the preceding BK image has moved away from a developing position thereof and before the trailing edge of a C latent image arrives thereat. As a result, the developer on the sleeve 15-1 is brought to an operative state to develop the C latent image with a C toner thereof. After the trailing edge of the C latent image has moved away from the C developing position, the developer on the sleeve 15-1 is retracted from the operative state. Again, this is completed before the leading edge of an M latent image to follow arrives at the C developing position. Procedures for forming M and Y images are identical with the above-described BK and C image forming procedures and will not be described to avoid redundancy.

In the intermediate transfer belt unit, the belt 19 is passed over the previously mentioned bias roller 20, a drive roller 21, and driven rollers and driven by a motor, not shown. A belt cleaning unit 22 includes a brush roller 22-1, a rubber blade 22-2, and a mechanism 22-3 for moving the cleaning unit 22 into and out of contact with the belt 19. A paper transfer unit 23 includes a bias roller 23-1, a roller cleaning blade 23-2, and a mechanism 23-3 for moving the transfer unit 23 into and out of contact with the belt 19. The bias roller 23-1 is usually spaced apart from the belt 19. When the composite color image completed on the belt 19 is to be collectively transferred to a paper sheet 24, the mechanism 23-2 urges the bias roller 23-1 against the belt 19. At the same time, a predetermined bias voltage is applied to the bias roller 23-1.

Referring again to FIG. 1, the paper sheet 24 is fed by a pick-up roller 25 to a registration roller 26. The registration roller 26 drives the paper sheet 24 toward a paper transfer position at such a timing that the leading edge of the sheet 24 meets the leading edge of the composite image formed on the belt 19. Subsequently, the paper sheet 24 carrying the composite image thereon is transported to a fixing unit 28 by a paper transport unit 27. In the fixing unit 28, a fix roller 28-1 controlled to a predetermined temperature cooperates with a press roller 28-2 to fix the image on the paper sheet 24 by heat. Finally, the paper sheet 24 is driven out to a copy tray 29 as a full color copy. After the transfer of the image from the belt 19 to the paper sheet 24, the mechanism 22-3 urges the belt cleaning unit 22 against the belt 19 to clean the surface of the belt 19.

Figure 2:
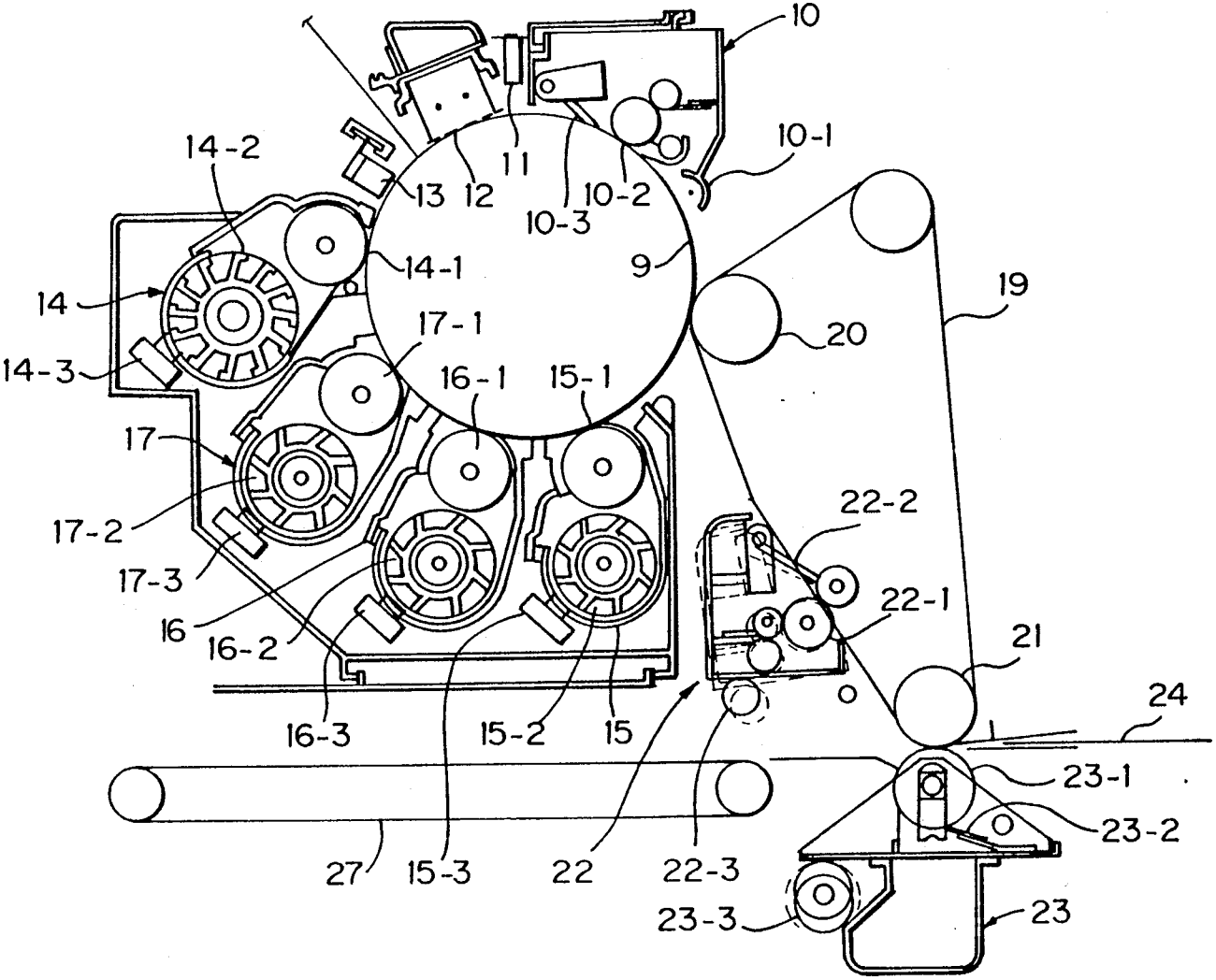
FIG. 2 is a fragmentary sectional side elevation showing the copier of FIG. 1 in an enlarged scale.

As shown in FIG. 2, after the belt transfer, the drum cleaning unit 10, i.e., a precleaning discharger 10-1, a rubber brush 10-2 and a rubber blade 10-3 clean the surface of the drum 9. Further, the discharge lamp 11 dissipates the charge remaining on the drum 9.

In a repeat copy mode, the procedure for forming the first Y (fourth color) image is followed by a procedure for forming the second BK (first color) image at a predetermined timing. The second BK toner image is transferred to part of the belt 19 having been cleaned by the belt cleaning unit 22. Thereafter, the procedure described in relation to the first copy is repeated. Cassettes 30, 31, 32 and 33 are each loaded with paper sheets of particular size. As a desired paper size is entered on an operation panel, not shown, sheets of the entered size are sequentially transported toward the registration roller 26. A manual tray 34 is available for allowing the operator to insert OHP (OverHead Projector) sheets, relatively thick sheets and other extra sheets by hand, as needed.

While the foregoing description has concentrated on a full color copy mode using four different colors, a tricolor or a bicolor copy mode is also practicable if the colors and the frequency of the iterative procedure are changed. On the other hand, in a monocolor copy mode, only one of the developing units 14–17 storing a toner of desired color is maintained operative (developer held in an operative position) until a desired number of copies have been produced. At this instant, the belt 19 is driven at a constant speed in the forward direction while contacting the drum 9. The belt cleaning unit 22 is also held in contact with the belt 19.

Figure 3:
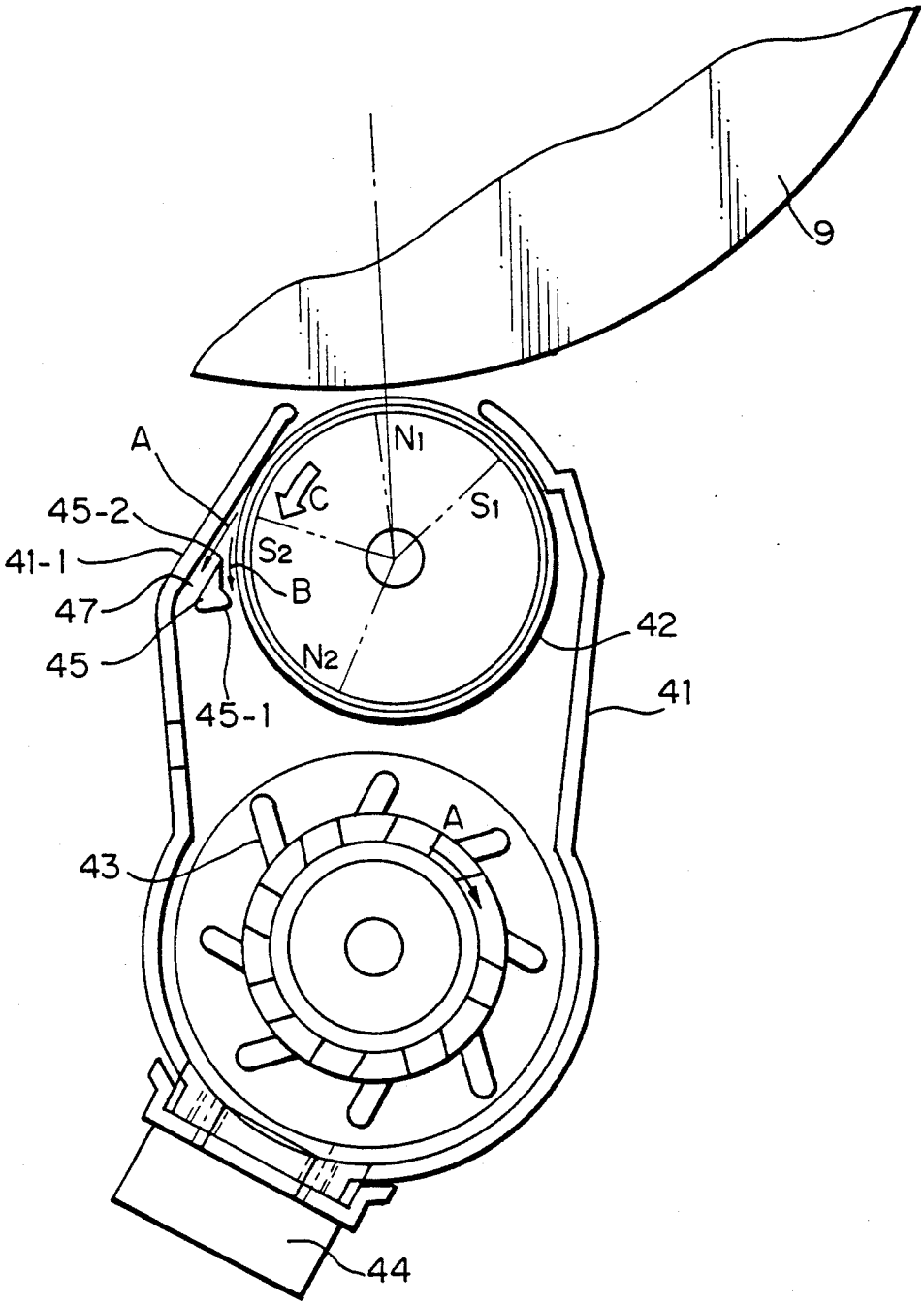
FIGS. 3–6 are fragmentary enlarged sections each showing an embodiment of the present invention.

Referring to FIG. 3, a developing device embodying the present invention will be described. As shown, the developing device has a developing unit or casing 41 located to face the surface of a photoconductive drum 9. A paddle 43 is disposed in the casing 41 for scooping and agitating a developer. A toner sensor 44 senses the toner concentration of the developer. A hollow cylindrical developing sleeve 42 has a magnetic field generating member thereinside and is rotatable relative thereto. A doctor 45 regulates the thickness of a layer formed by the developer on the developing sleeve 42. During development, the developing sleeve 42 is rotated in a direction opposite to the direction indicated by an arrow C in the figure. The paddle 43 is rotated in a direction indicated by an arrow A to agitate and convey the developer. Then, the developer is deposited on the developing sleeve 42 by the transport magnetic pole N2 of the sleeve 42. As the developer is transported by the developing sleeve 42, it is regulated in amount by the doctor 45. Part of the developer failed to pass the doctor 45 is let fall. On reaching a developing region, the developer develops a latent image electrostatically formed on the drum 9 due to the main magnetic pole N1 for development of the sleeve 42. After the development, the developer is further transported to the downstream side by the transport magnetic pole S1 of the sleeve 42. As this part of the developer reaches a region where no magnetic forces act, it comes off the sleeve 42. In this connection, the magnetic poles N1, N2, S1 and S2 are each representative of the center value (peak value) of the magnetic force distribution.

The doctor 45 has a doctor portion 45-1 and a branch portion 45-2. The doctor portion 45-1 extends toward the surface of the sleeve 42 to form a doctor gap between it and the sleeve 42. The branch portion 45-2 extends out from the doctor 45 at an acute angle at the upstream side with respect to the direction in which the sleeve 42 rotates for moving the developer to an inoperative position. When the developer is moved toward an inoperative position, the branch portion 45-2 introduces the developer into a bypass 47 as well as into the gap between the doctor portion 45-1 and the sleeve 42. In this configuration, the developer being moved toward an inoperative position is split by the branch portion 45-2 of the doctor 45 to flow in two directions A and B. This reduces the amount of developer to flow the narrow doctor gap and, therefore, frees the developer from undesirable stresses. While the bypass 47 is defined between the doctor 45 and part 41-1 of the casing 41, it may be located upstream of the doctor 45 with respect to the direction in which the sleeve 42 rotates for returning the developer to an inoperative position.

Figure 4:
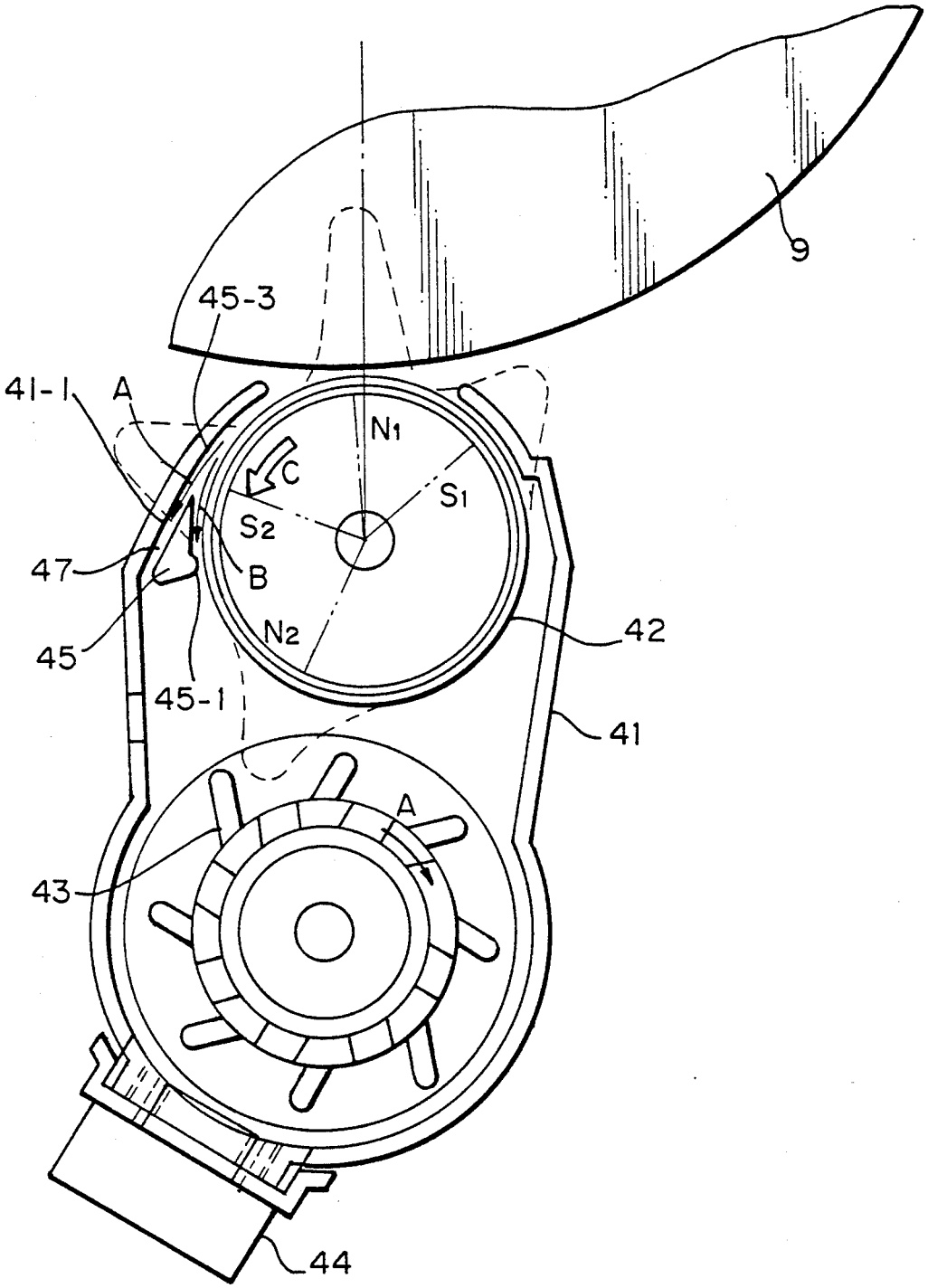

FIG. 4 shows an alternative embodiment of the present invention which is similar to the previous embodiment except for the configuration of the doctor 45. As shown, the doctor 45 has a branch portion 45-3 for causing the developer to flow into the branching doctor portion 45-1 and bypass portion 47 when moved toward an inoperative position, in addition to the doctor portion 45-1 which defines the doctor gap. In the figure, the dashed lines are representative of magnetic force distributions generated by the developing sleeve 42 in a direction normal to the surface of the sleeve 42. In the illustrative embodiment, the branch portion 45-3 is located at a position where the magnetic force distribution in the normal direction more intense than at the doctor portion 45-1. Specifically, the magnet brush formed by the developer on the sleeve 42 rises higher at the branch portion 45-3 than at the doctor portion 45-1. This allows the developer to easily split into two flows and reduces the stresses acting on the developer. The stresses are further reduced since the amount of developer to pass the narrow doctor gap is small. Preferably, the developer should split at a point where the magnetic force distribution in the normal direction is maximum.

The minimum gap of the bypass portion 47 is greater than the gap between the doctor portion 45-1 and the sleeve 42. When returned to an inoperative position, the magnet brush of the developer splits at the branch portion 45-3 to flow in two directions A and B. At the doctor portion 45-1 on which the magnetic force of the sleeve 42 intensely acts, the developer flowing in the direction B is attracted by the sleeve 42 and, therefore, can pass the doctor. On the other hand, the developer flowing in the direction A is remote from the magnetic pole, i.e., the force magnetically transporting it is weak. It follows that the developer flowing in the direction A can be smoothly transported due to the above-mentioned gap configuration of the bypass portion 47.

Figure 5:
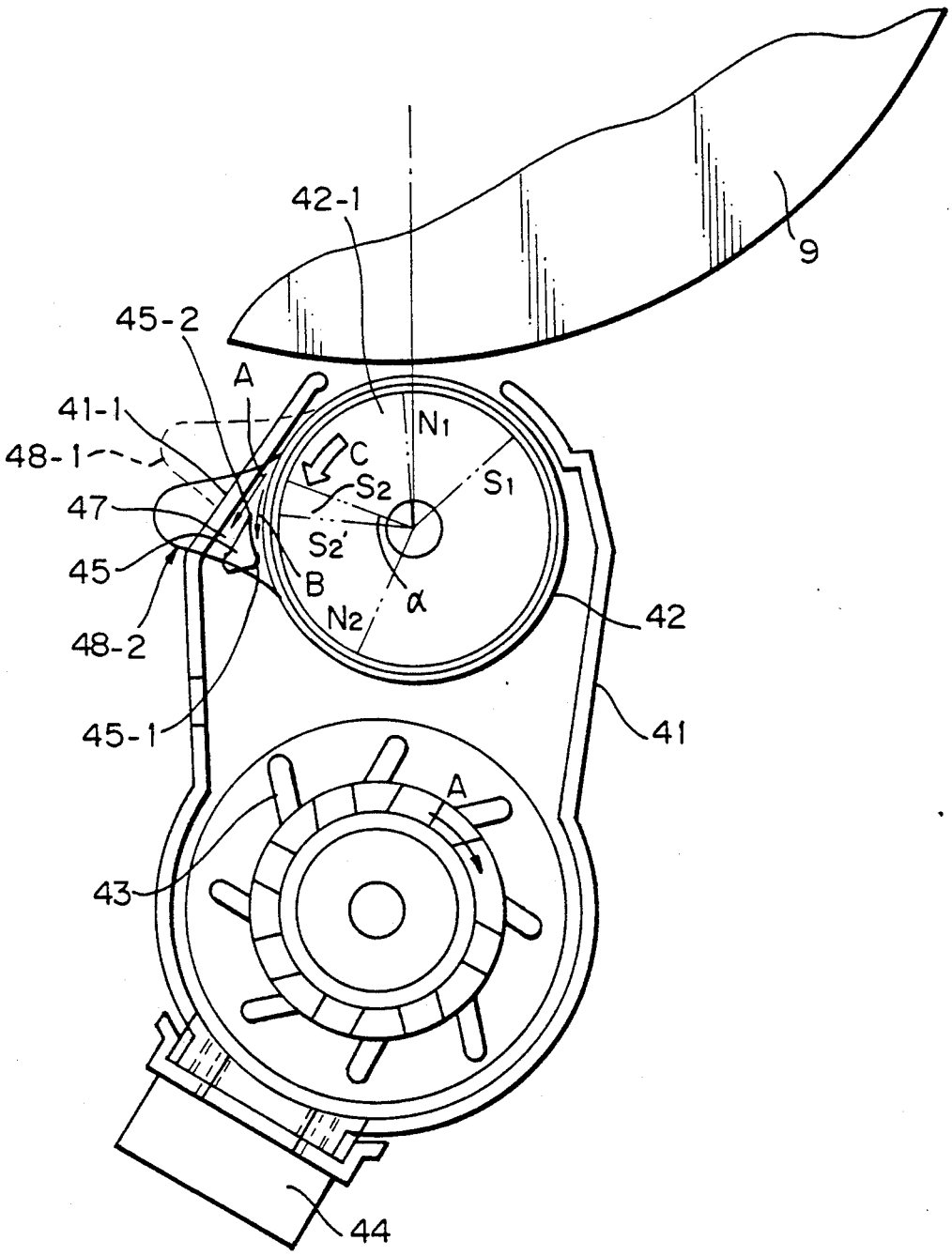

Referring to FIG. 5, another alternative embodiment of the present invention is shown. In this embodiment, to bring the developer to an inoperative position, a magnetic field generating member 48-1 disposed in the developing sleeve 42 is rotated in the direction C by an angle $\alpha$. Then, the transport magnetic pole S2 is shifted to a position S2′ while the magnetic force distribution 48-1 is shifted to a position 48-2. In this condition, the magnet brush of the developer on the sleeve 42 rises higher at the branch portion 45-2 than at the doctor portion 45-1. Hence, the developer easily splits into two flows and subjected to a minimum of stress. Of course, the magnetic force generating member 42-1 will be restored to the original position before the next development. The magnetic poles other than S2 are not shown in the figure.

Figure 6:
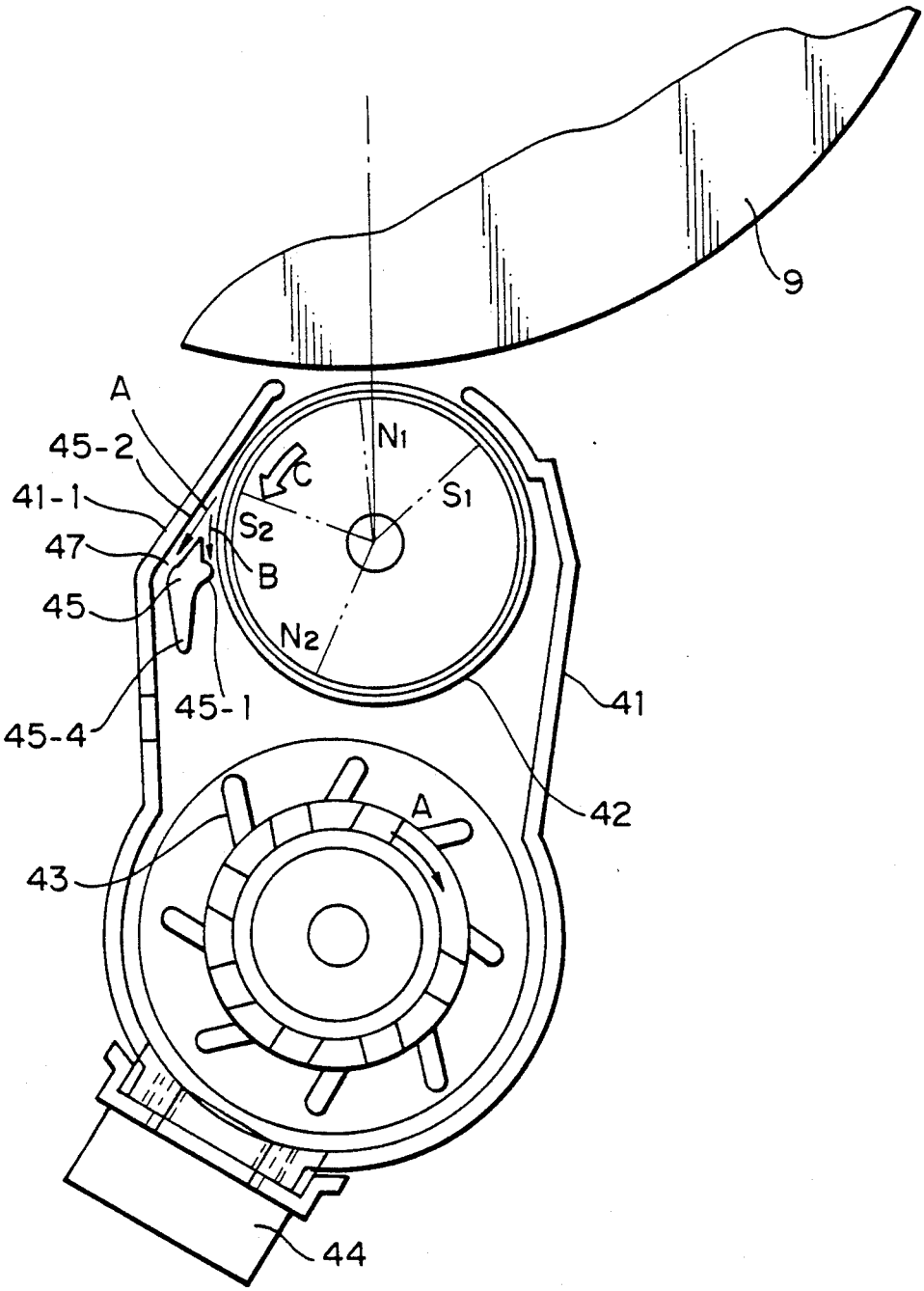

FIG. 6 shows another alternative embodiment of the present invention. As shown, the doctor 45 has an extension 45-4 extending to the downstream side in the direction C, i.e., in the direction of movement of the developer toward an inoperative position. The extension 45-4 prevents the magnetic force of the developing sleeve 42 from acting on the developer coming out of the bypass 47. In this configuration, the developer is prevented from depositing on the sleeve 42 again and is, therefore, efficiently brought to an inoperative position.

Figure 7:
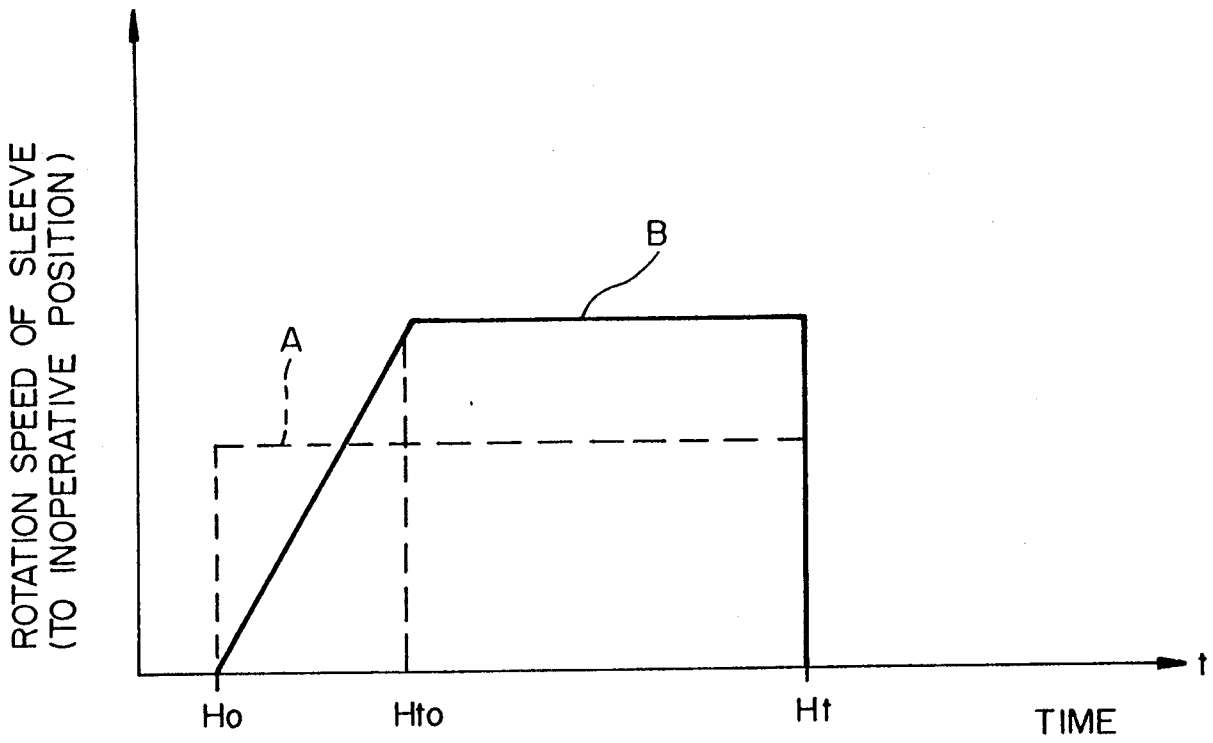
FIG. 7 is a graph comparing the present invention and the prior art with respect to the transition of the rotation speed of a developing speed to occur when a developer is brought to an inoperative position.

Referring to FIG. 7, a dashed line A is indicative of a conventional transition of the rotation speed of the developing sleeve to occur when the developer is brought to an inoperative position, while a solid line B is indicative of a transition particular to the present invention. As shown, it has been customary to rotate the sleeve at a constant speed from the beginning (t=H0) to the end (t=Ht) of the movement of the developer to an inoperative position. In accordance with the present invention, the rotation of the sleeve is sequentially accelerated from the beginning (t=H0) of such a movement of the developer to a particular time (t=Ht0) and then maintained constant to the end of the movement of the developer (t=Ht). This prevents the rotation speed of the sleeve from exceeding the allowable range of load to act on the photoconductive drum, thereby, eliminating the degradation of image quality due to changes in the load of the drum.

Figure 8:
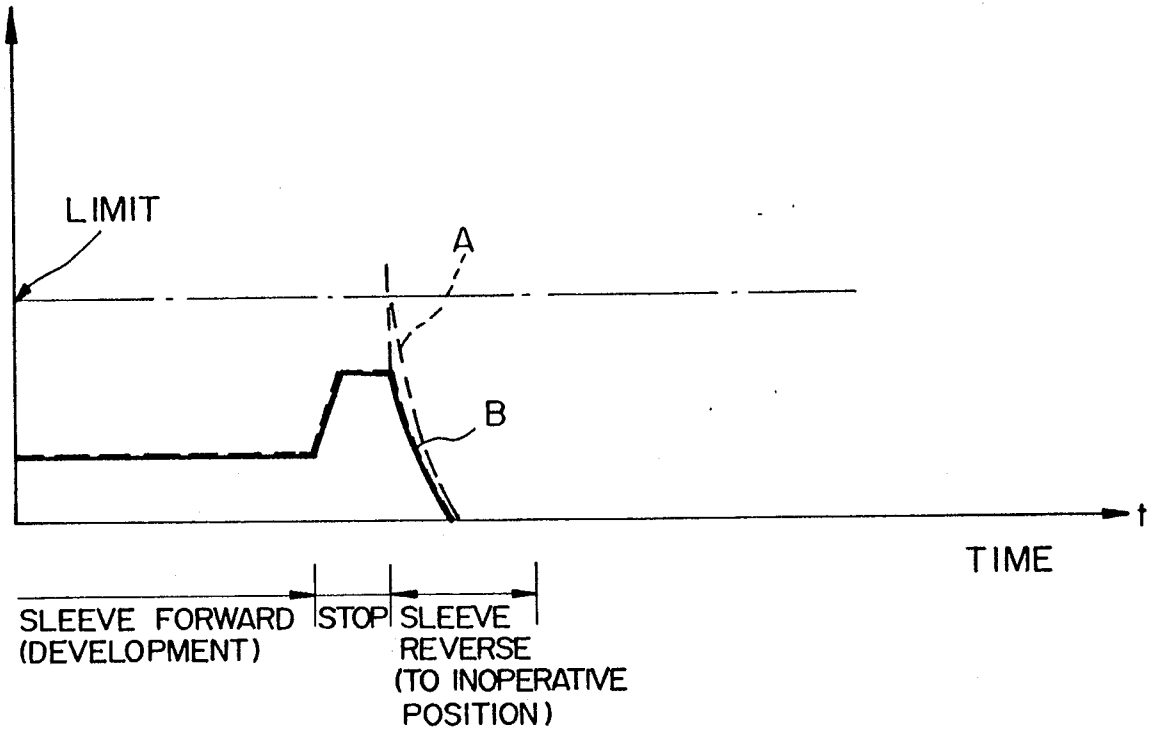
FIG. 8 is a graph comparing the present invention and the prior art with respect to the change in the load to act on a photoconductive drum around the time when a developer is brought to an inoperative position.

FIG. 8 is a graph comparing the prior art and the present invention with respect to the change in the load of the photoconductive drum ascribable to the movement of the developer to an inoperative position. During development, the developing sleeve rotates in the same direction as the photoconductive drum, so that the load acting on the drum is light. However, after the development, the sleeve is once brought to a stop. Therefore, the load sequentially increases until the stop of the sleeve and does not increase thereafter. To move the developer to an inoperative position, the rotation of the sleeve is reversed. The load temporarily increases at the beginning of the reverse rotation since much developer exists at the developing region, and then sequentially decreases as the developer decreases. When the developer decreases to below a particular amount, the load on the drum becomes zero. In FIG. 8, the dash-and-dot line is indicative of the allowable range of load to act on the drum; as the load exceeds the allowable range, the rotation speed of the drum cannot be maintained constant. Specifically, the prior art (dashed line A) causes the load to exceed the allowable range at the beginning of the reverse rotation. By contrast, the present invention (solid line B) reduces the load at the beginning of the reverse rotation since it sequentially increases the rotation speed of the sleeve in relation to the decrease in the amount of developer.

Figure 9:
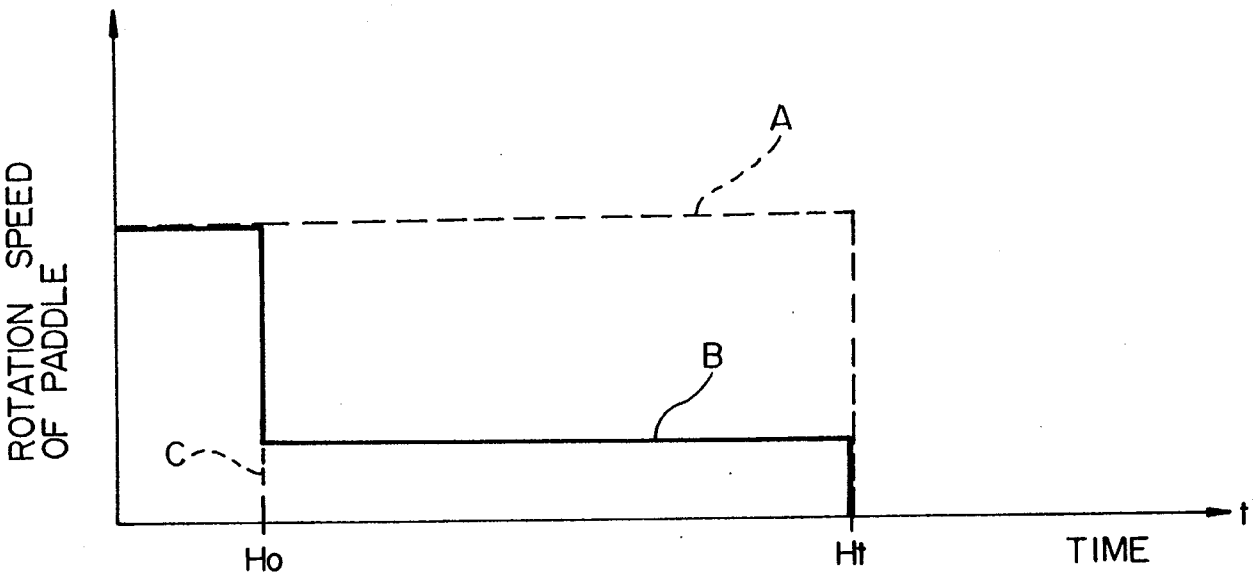
FIG. 9 is a graph comparing the present invention and the prior art with respect to the transition of the rotation speed of a paddle to occur when a developer is brought to an inoperative position.

Referring to FIG. 9, a dashed line A is indicative of a conventional transition of the rotation speed of the paddle to occur when the developer is moved to an inoperative position, while a solid line B is indicative of a transition particular to the present invention. As shown, it has been customary to rotate the paddle at a constant speed form the beginning (t=H0) to the end (t=Ht) of such a movement of the developer. In accordance with the present invention, the paddle is rotated at a lower speed than during development after the movement of the developer has begun (t=H0) and then brought to a stop at the end of the movement (t=Ht). Alternatively, in accordance with the present invention, the rotation of the paddle may be stopped immediately after the beginning of the movement of the developer (t=H0), as represented by a dash-and-dots line C in the figure. Lowering the rotation speed of the paddle in the above condition is successful to eliminate the previously discussed problems. Moreover, since the paddle is not fully stopped, the developer dropped (or collected) form the sleeve is prevented from accumulating in a particular portion; that is, the rotation of the paddle should preferably be only slowed down.

Figure 10:
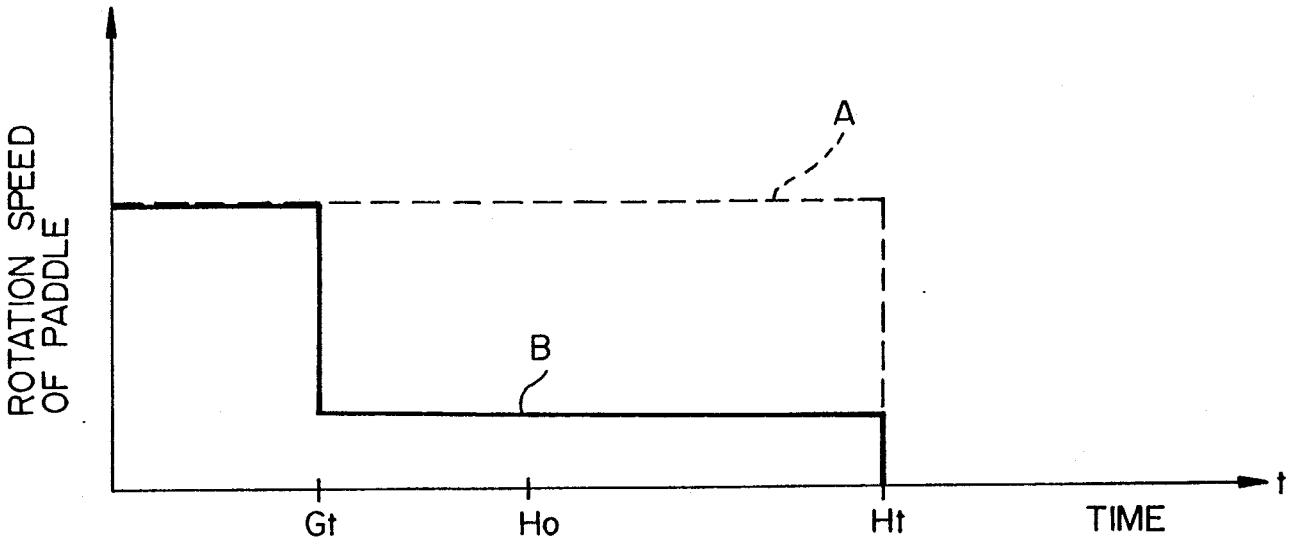
FIG. 10 is a graph comparing the present invention and the prior art with respect to the rotation speed of the paddle to occur around the time when a developer is brought to an inoperative position.

FIG. 10 is a graph comparing the prior art and the present invention with respect to the rotation speed of the paddle around the time when the developer is brought to an inoperative position. As shown, the prior art (dashed line A) causes the paddle to rotate at a constant speed from the time (t=Gt) when a latent image formed on the image carrier passes the developing region to the time (t=Ht) when the movement of the developer ends. In accordance with the present invention (solid line B), the paddle is rotated at a lower speed than during development after the latent image has passed the developing region (t=Gt) and then brought to a stop at the end of the movement of the developer (t=Ht).

Figure 11:
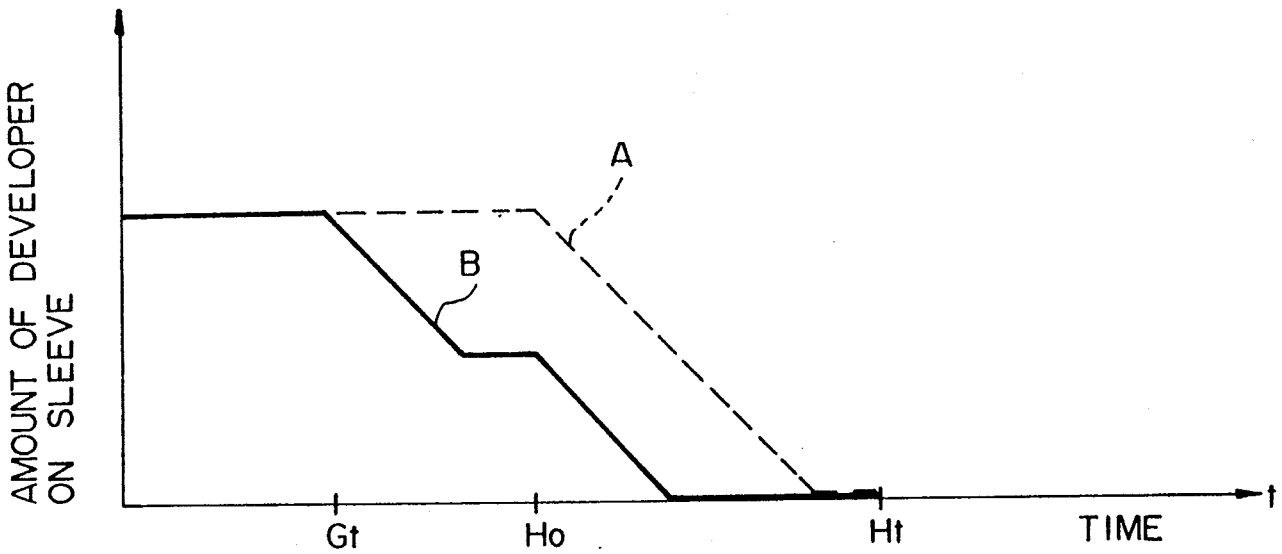
FIG. 11 is a graph comparing the present invention and the prior art with respect to the amount of developer remaining on a developing sleeve around the time when a developer is brought to an inoperative position.

More specifically, FIG. 11 shows the amount of developer conventionally present on the developing sleeve around the time when the developer is moved to an inoperative position (dashed line A), and the amount of such a developer particular to the present invention (solid line B). As shown, in the prior art, the amount of developer deposited on the sleeve does not change until the beginning of the movement of the developer (t=H0) and then decreases as the movement begins. By contrast, in accordance with the present invention, the rotation speed of the paddle is lowered when a latent image formed on the drum passes the developing region (t=Gt) (see FIG. 10). As a result, the developer present on the sleeve is reduced before the movement of the developer beings (t=H0). This reduces the period of time necessary for the developer to disappear from the sleeve due to the subsequent movement to an inoperative position. Stated another way, for the same period of time, the present invention is capable of moving the developer to an inoperative position more satisfactorily than the prior art. Furthermore, since the amount of developer remaining on the sleeve at the beginning of such a movement is small, the load to act on the drum at the time of stop and reversal of the sleeve is reduced.

While the embodiments have been shown and described in relation to a single developing unit, they are, in practice, effected in consideration of the various operation timings, including the movement of the developer to an inoperative position, of a plurality of developing units. Of course, the embodiments of the present invention may be suitably combined, if desired. The operations of various constituent parts are, of course, controlled by a microcomputer or similar controller, not shown.

In summary, it will be seen that the present invention provides a developing device which, when moving a developer to an inoperative position, causes part of the developer to flow a bypass to thereby effect such a movement of the developer surely and rapidly. Hence, despite that a gap for development is narrow, the developer remaining on a developing sleeve is prevented from disturbing a latent image and corresponding toner image formed on a photoconductive element, insuring attractive images.

The device of the present invention splits the developer moving toward an inoperative position into two flows with a doctor branch portion. The reduces the amount of developer to flow through the narrow doctor gap and, therefore, reduces stresses to act on the developer at the time. Consequently, wasteful toner consumption and contamination are eliminated to maintain desirable image quality over a long period of time.

Further, in the event of moving the developer to an inoperative position, the device sequentially accelerates the rotation of the developing sleeve, lowers the rotation speed of a paddle than during development, and reduces the amount of developer to pass the doctor after a latent image formed on a photoconductive element has moved away from a developing region and before the movement of the developer, i.e., while the sleeve is rotating in the same direction as during development. As a result, the device prevents the load acting on the drum from changing, thereby insuring high quality copies.

Various modifications will become possible for those skilled in the art receiving the teachings of the present disclosure without departing from the scope thereof.

What is claimed is:

1. A developing device capable of bringing a developer deposited on a developing sleeve to an inoperative position by rotating said developing sleeve in a direction opposite to a direction for development, said device comprising:

a doctor means for regulating a thickness of a layer formed by the developer on said developing sleeve, said developer flowing through a gap between the said doctor means and said developing sleeve when transported toward the inoperative position in a reverse direction; and a bypass for causing part of the developer being transported in the reverse direction of flow therethrough.

2. A device as claimed in claim 1, wherein said bypass path is formed between said doctor means and an inner wall of a causing included in said developing device.

3. A device as claimed in claim 2, wherein a minimum distance between said doctor means and said inner wall of said casing is greater than a distance between said doctor means and said developing sleeve.

4. A device as claimed in claim 1, wherein a magnetic field generating member is disposed in said developing sleeve.

5. A device as claimed in claim 4, wherein at a position upstream of said doctor means with respect to an intended direction of rotation of said developing sleeve for moving the developer to the inoperative position and where a magnetic force generated by said magnetic field generating member in a direction normal to said developing sleeve is more intense than at said doctor means, the developer being moved toward the inoperative position is split into two flows to partly flow said.

6. A device as claimed in claim 4, wherein when the developer is moved toward the inoperative position, said magnetic field generating member is rotated, while a magnetic force generated by said magnetic field generating member in a direction normal to said developing sleeve is made more intense at a splitting portion of said doctor means than during development.

7. A device as claimed in claim 1, wherein when the developer is moved toward the inoperative position, a rotation speed of said developing sleeve is sequentially increased.

8. A device as claimed in claim 1, further comprising agitating means for agitating the developer and conveying said developer to said developing sleeve.

9. A device as claimed in claim 8, wherein when the developer is moved toward the inoperative position, a paddle of said agitating means is rotated at a lower speed than during development or brought to a stop.

10. A device as claimed in claim 8, wherein an amount of the developer passing said doctor means is reduced after a latent image has moved away from a developing region and before the movement of the developer toward the inoperative position, until which time said developing sleeve is rotated in the same direction as during development.

* * * * *

UNITED STATES PATENT AND TRADEMARK OFFICE

CERTIFICATE OF CORRECTION

PATENT NO. : 5,327,199

DATED : July 5, 1994

INVENTOR(S) : Takeyoshi SEKINE

It is certified that error appears in the above-indentified patent and that said Letters Patent is hereby corrected as shown below:

On the title page, Item [54] and Column 1, Lines 2 & 3, the title should read as follows:

--DEVELOPING DEVICE FOR A COLOR IMAGE FORMING APPARATUS HAVING A DOCTOR WHICH CREATES A BYPASS PATH--

Signed and Sealed this

Eighteenth Day of October, 1994

Bruce Lehman

*Attest:*

BRUCE LEHMAN

*Attesting Officer*

*Commissioner of Patents and Trademarks*